United States Patent [19]

Kallin

[11] Patent Number: 4,789,151

[45] Date of Patent: Dec. 6, 1988

[54] QUICKLY ASSEMBLED APPARATUS FOR MOVING DOCUMENTS

[75] Inventor: Fredrik L. N. Kallin, Kitchener, Canada

[73] Assignee: NCR Corporation, Dayton, Ohio

[21] Appl. No.: 137,831

[22] Filed: Dec. 24, 1987

[51] Int. Cl.[4] ..... B65H 5/06

[52] U.S. Cl. ..... 271/274

[58] Field of Search ..... 271/274, 272, 273, 181

[56] References Cited

U.S. PATENT DOCUMENTS

| | | | |
|---|---|---|---|
| 4,448,554 | 5/1984 | Driemeyer | 400/124 |
| 4,506,878 | 3/1985 | Bashford | 271/227 |
| 4,607,835 | 8/1986 | Wilson | 271/274 |
| 4,613,127 | 9/1986 | Wishart | 271/274 |
| 4,643,091 | 2/1987 | Fairey | 101/233 |

*Primary Examiner*—Richard A. Schacher

*Attorney, Agent, or Firm*—Wilbert Hawk, Jr.; Albert L. Sessler, Jr.; Elmer Wargo

[57] ABSTRACT

A quickly assembled apparatus for moving documents, like checks, along a document track. The apparatus includes a drive roller assembly having a first shaft extending therefrom and an idler roller assembly having a second shaft extending therefrom, with the idler roller assembly being biased into engagement with the drive roller assembly to drive a document therebetween. The drive roller assembly has a two piece housing which seats two ball bearings which support the drive roller assembly which also has first and second elastomeric members positioned on the periphery thereof to function as first and second drive rollers. The idler roller assembly has first and second ball bearings whose outer races function as first and second idler rollers for engagement with the first and second drive rollers.

12 Claims, 3 Drawing Sheets

QUICKLY ASSEMBLED APPARATUS FOR MOVING DOCUMENTS

BACKGROUND OF THE INVENTION

This invention relates to an apparatus for moving documents in a document track, and more particularly, it relates to such an apparatus which is especially useful in moving documents like checks, for example, in business machines associated with financial environments.

In recent years, there has been a trend in designing document moving apparatuses so that the apparatuses are quickly assembled so as to reduce manufacturing costs. Another trend is to design the apparatuses so that they operate at high speeds so as to increase the throughput of documents like checks and deposit slips, for example, being fed by the apparatuses. When higher speeds were required, some of the prior art designs appeared to have too much inertia in them. Another problem with some of the prior art designs was that replacement of parts in the field was cumbersome, at times, requiring extensive downtime.

SUMMARY OF THE INVENTION

In contrast with the prior art apparatuses mentioned, the present invention is easily assembled without the use of screws, and it is easily repaired in the field.

The present invention also provides a smaller rotating inertia compared to the prior art apparatuses mentioned, making starting and stopping the rotation of the drive and idler rollers easier.

The present invention is also economical to manufacture.

A preferred embodiment of this invention relates to an apparatus for moving documents including: a base plate having first and second mounting members thereon; a document track having first and second mounting holes therein which are aligned with said first and second mounting members, respectively, when said document track is positioned on said baseplate for assembly thereto; a first shaft having a drive roller assembly rotatably mounted thereon; an idler roller assembly having a second shaft extending therefrom; said first shaft passing through said first mounting hole and being secured with said first mounting member to secure said drive roller assembly and said document track to said base plate; said second shaft passing through said second mounting hole and being secured with said second mounting member to secure said idler roller assembly and said document track to said base plate; said drive roller assembly having at least one drive roller thereon, and also having means for rotating said drive roller; said idler roller assembly having at least one idler roller thereon; and biasing means for resiliently biasing said idler roller into engagement with said drive roller for driving a document therebetween.

The above advantages and others will be more readily understood in connection with the following description, claims, and drawing.

DETAILED DESCRIPTION OF THE INVENTION

Figure 1:
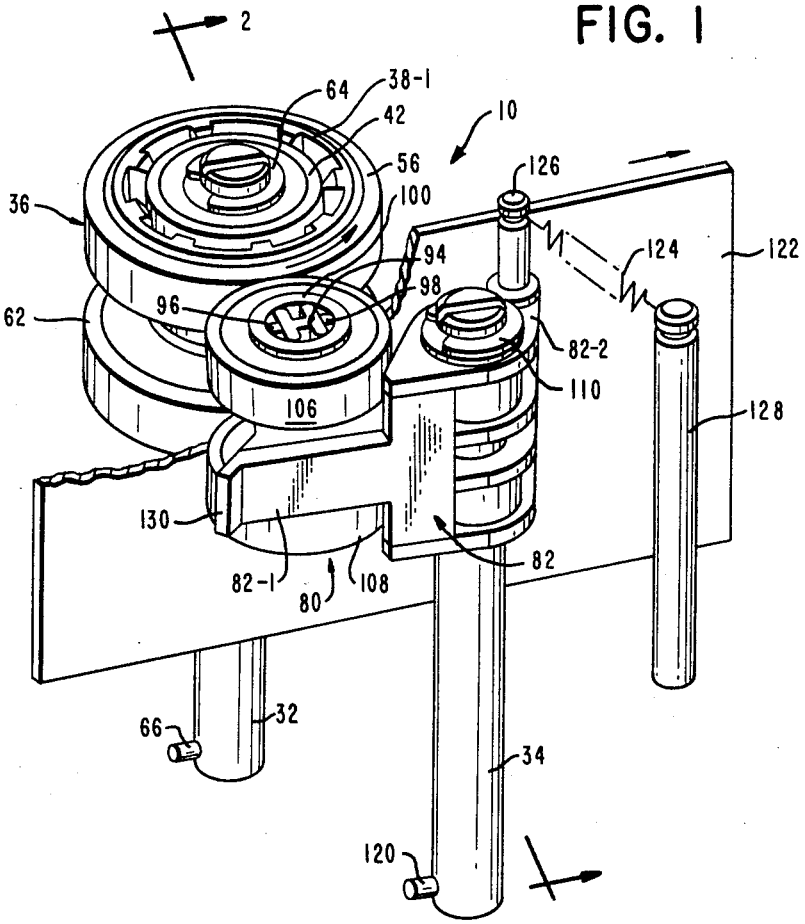
FIG. 1 is a general view, in perspective, showing a drive roller assembly and an associated pinch roller assembly made according to a preferred embodiment of this invention.
Figure 2:
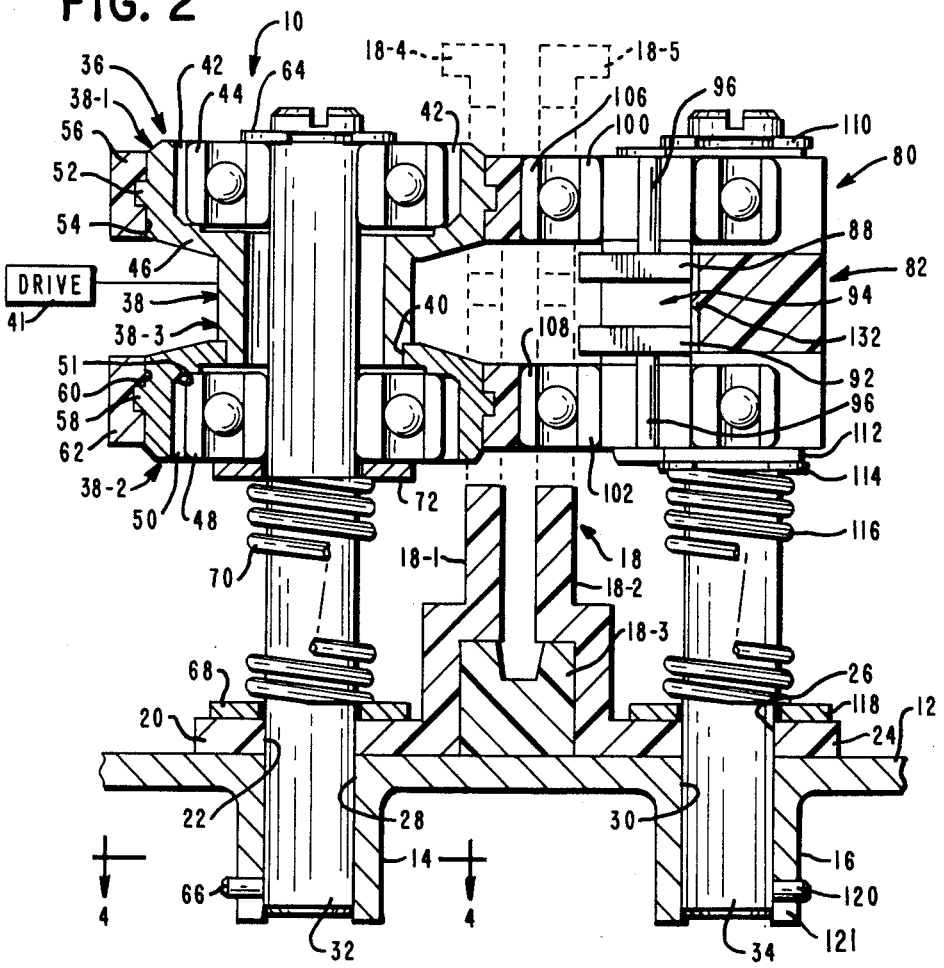
FIG. 2 is a general, cross-sectional view, taken along the line 2—2 of FIG. 1 to show additional details of the drive and idler roll assemblies shown in FIG. 1 and also to show the relationship of these assemblies to a base plate and document track included in the apparatus of this invention.

FIGS. 1 and 2 show, essentially, the apparatus of this invention which is designated generally as 10. The apparatus 10 includes a baseplate 12 having mounting housings or members 14 and 16 depending from the bottom side of the baseplate 12 as shown in FIG. 2.

The apparatus 10 also includes the document track 18 (FIG. 2) which is comprised of the upstanding walls 18-1 and 18-2 and the trough portion or bottom 18-3. The upstanding walls 18-1 and 18-2 have offset portions as shown to retain the bottom portion 18-3 on the baseplate 12 when the track 18 is assembled thereto. The upper portions 18-4 and 18-5 of the upstanding walls 18-1 and 18-2, respectively, are shown in dashed outline to simplify the drawing. The upstanding wall 18-1 has a mounting flange 20 with an aperture 22 therein, and correspondingly, the upstanding wall 18-2 has a mounting flange 24 with an aperture 26 therein. The apertures 22 and 26 are aligned with the apertures 28 and 30 in the first and second mounting members 14 and 16 when the document track is positioned on the baseplate 12 for assembly thereto. When so aligned, a first shaft 32 is moved through the aperture 22 and the aperture 28 of the mounting member 14 to retain the wall 18-1 on the baseplate 12 as will be described hereinafter. Correspondingly, a second shaft 34 is moved through the aperture 26 in the flange 24 and through the aperture 30 in the mounting member 16 to retain the wall 18-2 on the baseplate 12. This is one of the features of this invention which facilitates the assembly of the apparatus 10 without using a lot of fasteners, like screws, for example.

The apparatus 10 also includes a drive roller assembly which is designated generally as 36 and which is rotatably mounted on the first shaft 32. The drive roller assembly 36 includes a generally cylindrically-shaped housing 38 having an upper body portion 38-1, a lower body portion 38-2, and a central body portion 38-3 which are assembled as shown in FIG. 2. The central body portion 38-3 has an annular recess 40 formed on its exterior to receive the lower body portion 38-2 which is press fitted thereon to form the housing 38 as shown best in FIG. 2.

Figure 3:
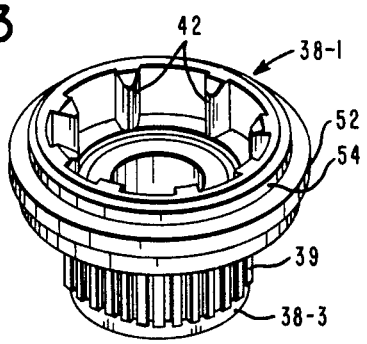
FIG. 3 is a general perspective view of a portion of the housing associated with a drive roller assembly used in the apparatus shown in FIGS. 1 and 2.

The upper body portion 38-1, shown best in FIG. 3, has plurality of radially-aligned ribs 42 which are formed on the interior thereof to support the outer race of the ball bearing 44 which is seated on area 46 (FIG. 2) of the upper body portion 38-1. A second bearing has its outer race 48 similarly supported by ribs 50 and area 51 located in the lower body portion 38-2. The upper body portion 38-1 has an annular rib 52, projecting from a peripheral wall 54, to detachably secure an elastomeric member 56 thereon. The elastomeric member 56 effectively becomes the first drive roller for the drive roller assembly 36. Correspondingly, the lower body portion 38-2 has an annular rib 58 projecting from a peripheral wall 60 to detachably secure an elastomeric member 62 thereon. The elastomeric member 62 effectively becomes the second drive roller of the drive roller assembly 36.

The central body portion 38-3 has a plurality of vertically-positioned ribs 39 (FIG. 3) formed around the exterior thereof to form a drive pulley for rotating the drive assembly 36. A suitable timing belt and motor shown only as drive 41 in FIG. 2 are used to rotate the drive roller assembly 36.

By the construction described, the drive roller assembly 36 is rotatably mounted on the first shaft 32. Notice that the first shaft 32 remains stationary while the drive roller assembly 36 rotates. This construction provides for a smaller moment of inertia compared to some of the prior art constructions which utilize a drive pulley fixed to the shaft which is used to rotate the associated drive pulleys. A "C" clip 64 is used to retain the drive roller assembly 36 on the upper end of the shaft 32.

Figure 4:
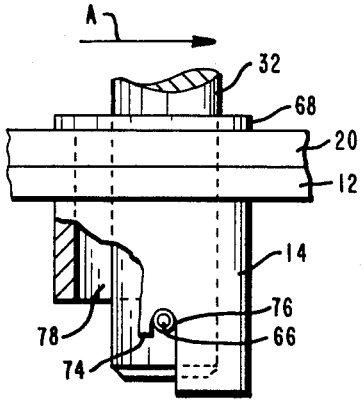
FIG. 4 is a general view, taken from the direction A in FIG. 2, to show additional details of a mounting member which depends from the bottom side of the baseplate.

The lower end of the shaft 32 has a projection 66 extending therefrom to cooperate with the mounting member 14 (FIG. 2) to secure the document track 18 and the drive roller assembly 36 to the base plate 12. To assemble the drive roller assembly 36, a washer 68, compression type spring 70, and washer 72 are placed on the shaft 32 above the projection 66. The housing 38, with the bearings 44 and 48 therein, is then slid on the shaft 32 and the "C" clip 64 is used to retain the entire drive roller assembly 36 on the first shaft 32. After the aperture 22 in the document track 18 is aligned with the aperture 28 in the base plate 12, the lower end of the shaft 32 with the projection 66 thereon is aligned with a complementary recess 78 (FIG. 4) or slot in the flange 20 of the document track 18 and the first member 14. The entire drive roller assembly 36 is then pushed downwardly as viewed in FIG. 2 against the bias of the spring 70 until the projection 66 clears the lower edge 74 (FIG. 4) of the member 14, and then, the shaft 32 is rotated in a counterclockwise direction (as viewed in FIG. 1) until the projection 66 encounters the complementary recess 76 FIG. 4). The compression spring 70 then pushes the projection 66 up into the recess 76, which locks the shaft 32 from a rotational standpoint.

Figure 5:
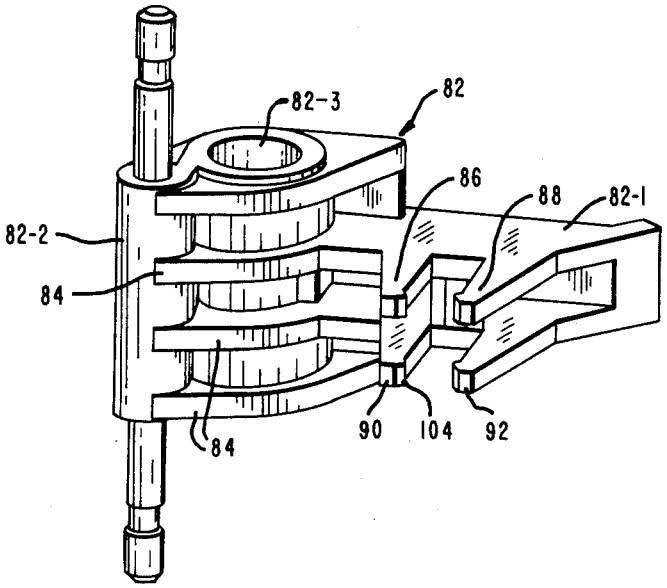
FIG. 5 is a general perspective view of a support member which is used to support the idler rollers shown in FIGS. 1 and 2.

The apparatus 10 also includes the idler roller assembly which is designated generally as 80 and which is shown basically in FIGS. 1 and 2. The idler roller assembly 80 includes a support member 82 shown best in FIG. 5. The support member 82 has a first end 82-1 and a second end 82-2 and also has a mounting hole 82-3 to enable the support member to be rotatably mounted between its ends on the second shaft 34.

The support member 82 is made of plastic material, and it has suitable ribs 84 to reinforce it. The first end 82-1 has a pair of spaced upper fingers 86 and 88 extending therefrom and a pair of spaced lower fingers 90 and 92 extending therefrom (as shown best in FIG. 5) which are designed to receive a "shaft" 94 therebetween.

The shaft 94 has a general "H"-shaped configuration, as shown in FIG. 1, with the ribs 96 and 98 extending from opposed sides of the "H" configuration and being discontinuous at the fingers 86–92 to enable the shaft 94 to be supported by the fingers 86–92. The shaft 94 is made of plastic material which deforms slightly when the inner race 100 of the upper ball bearing is forced thereon. Similarly, the inner race 102 (FIG. 2) of the lower ball bearing is forced on the lower end of the shaft 94. The fingers 86–92 have detents, like 104 in FIG. 5, which retain the shaft 94 within these fingers which are slightly flexible to accommodate the shaft 94.

Notice from the construction just described that the metal outer race 106 of the upper ball bearing becomes the idler roller which faces the upper drive roller represented by the elastomeric member 56. Correspondingly, the metal outer race 108 of the lower ball bearing becomes the idler roller which faces the lower drive roller represented by the elastomeric member 62.

The support member 82 is rotatably supported on the shaft 34 and is retained thereon by an upper "C" clip 110 shown in FIG. 2 and a washer 112 and lower "C" clip 114. A compression spring 116 is positioned between the "C" clip 114 and washer 118 to mount the idler roller assembly 80 and the document track 18 on the base plate 12 in a manner which is identical to that already explained in relation to mounting the drive roller assembly 36 on the base plate 12. In this regard, the second shaft 34 has a projection 120 extending therefrom which is retained in a cooperating recess 121 similar to recess 76 shown in FIG. 4.

Another feature of the apparatus 10 is that the idler roller assembly 80 can be moved away from the drive roller assembly 36 to facilitate the removal of a document 122 which might become jammed therebetween. In this regard, the idler roller assembly 80 is resiliently biased into engagement with the drive roller assembly 36 by the tension spring 124 which rotates the support member 82 in a clockwise direction as viewed in FIG. 1. One end of the spring 124 is connected to a post 126 upstanding from the second end 82-2 of the support member 82, and the remaining end thereof is connected to a post 128 which is upstanding from and secured to the base plate 12. To move the idler roller assembly 80 to an inoperative or displaced position, the support member 82 is grasped at the finger area 130 and moved in a counterclockwise direction until the support member reaches an over-the center position to be retained in this position. The support member 82 is dimensioned and the shaft 34 and the post 128 are located on the baseplate 12 to bring about, conventionally, the over-the-center position mentioned. The force of the spring 116 is not permitted to abut against the lower side of the idler roller assembly 80 (via the "C" clip 114) so as to not oppose the biasing effects of spring 124. After the jammed document 122 is removed, the idler roller assembly 80 is moved towards the drive roller assembly 36 to resume the feeding operation. The support member 82 has a horizontally extending rib 132 (FIG. 2) projecting therefrom to enable the idler roller assembly 80 to pivot about a horizontal axis to enable the outer races 106 and 108 to conform to the associated elastomeric members 56 and 62, respectively, on the drive roller assembly 36.

What is claimed is:

1. An apparatus for moving documents comprising:

a base plate having first and second mounting members thereon;

a document track having first and second mounting holes therein which are aligned with said first and second mounting members, respectively, when said document track is positioned on said baseplate for assembly thereto;

a first shaft having a drive roller assembly rotatably mounted thereon;

an idler roller assembly having a second shaft extending therefrom;

said first shaft passing through said first mounting hole and being secured with said first mounting member to secure said drive roller assembly and said document track to said base plate;

said second shaft passing through said second mounting hole and being secured with said second mounting member to secure said idler roller assembly and said document track to said base plate;

said drive roller assembly having at least one drive roller thereon, and also having means for rotating said drive roller;

said idler roller assembly having at least one idler roller thereon; and biasing means for resiliently biasing said idler roller into engagement with said drive roller for driving a document therebetween.

2. The apparatus as claimed in claim 1 in which said driving roller has an elastomeric surface thereon and said idler roller is a bearing having outer and inner races, with said outer race being resiliently biased into engagement with said elastomeric surface.

3. The apparatus as claimed in claim 2 in which said drive roller assembly comprises:

a housing having upper, lower, and central body portions;

first and second bearings mounted in said upper and lower body portions, respectively, to rotatably mount said housing on said said first shaft;

said central body portion having means thereon for rotating said housing; and said upper body portion functioning as said driving roller and also having said elastomeric surface thereon to engage said outer race of said bearing of said idler roller.

4. The apparatus as claimed in claim 3 in which said first shaft has first and second ends, and in which said first end has means for retaining said drive roller assembly thereon;

said second end having a projection extending therefrom;

said first mounting member being shaped to receive said second end and also having a locking recess therein; and said apparatus also including a resilient member positioned between said document track and said drive roller assembly to bias said drive roller assembly towards said first end of said first shaft while retaining said document track on said base plate after said second end is moved into said first mounting member and said first shaft is rotated to move said projection into said locking recess.

5. The apparatus as claimed in claim 1 in which said idler roller assembly comprises:

a support member pivotally mounted on said second shaft;

said support member having a first end on which said idler roller is mounted, and also having a second end, with said support member being pivotally mounted between the associated said first and second ends on said second shaft; and said biasing means being secured to said second end of said support member to bias said idler roller into engagement with said drive roller.

6. The apparatus as claimed in claim 5 in which said support member, said first and second shafts, and said biasing means are located with respect to one another to provide an over-the-center position when said idler roller is moved away from said drive roller against the bias of said biasing means to enable said idler roller to be held in a displaced position relative to said drive roller to facilitate the removal of a jammed document between said drive and idler rollers.

7. An apparatus for moving documents comprising:

a base plate having first and second mounting housings thereon;

a document track having first and second mounting holes therein which are aligned with said first and second mounting housings, respectively, when said document track is positioned on said baseplate for assembly thereto;

a drive roller assembly having a first shaft extending therefrom;

an idler roller assembly having a second shaft extending therefrom;

said first shaft passing through said first mounting hole and being secured to said first mounting housing to secure said drive roller assembly and said document track to said base plate;

said second shaft passing through said second mounting hole and being secured to said second mounting housing to secure said idler roller assembly and said document track to said base plate;

said drive roller assembly having a housing including upper, lower, and central body portions;

first and second bearings mounted in said upper and lower body portions, respectively, to rotatably mount said housing on said said first shaft;

said central body portion having means thereon for rotating said housing; and said upper body portion and said lower body portion having first and second drive rollers mounted thereon, respectively;

said idler roller assembly comprising:

a support member pivotally mounted on said second shaft;

said support member including a first end, and also having a second end, with said support member being pivotally mounted between the associated said first and second ends on said second shaft; and first and second ball bearings rotatably mounted on said support member at said first end, with said first and second ball bearings having first and second outer races aligned with said first and second drive rollers; and a biasing means being secured to said second end of said support member to bias said first and second outer races into engagement with said first and second drive rollers, respectively for driving a document therebetween.

8. The apparatus as claimed in claim 7 in which said upper and lower body portions have first and second cylindrically shaped portions to receive thereon, respectively, first and second elastomeric members which form said first and second drive rollers.

9. The apparatus as claimed in claim 8 in which which said support member, said first and second shafts, and said biasing means are located with respect to one another to provide an over-the-center position when said first and second idler rollers are moved away from said first and second drive rollers against the bias of said biasing means to enable said first and second idler rollers to be held in a displaced position relative to said first and second drive rollers to facilitate the removal of a jammed document between said first and second drive rollers and said first and second idler rollers.

10. The apparatus as claimed in claim 9 in which said support member includes a mounting member for mounting said first and second idler rollers thereon, said support member lower fingers extending therefrom to detachably receive said mounting member with said first and second idler rollers thereon.

11. The apparatus as claimed in claim 10 in which said support member has a pivot point extending therefrom to enable said mounting member to pivot slightly about an axis which is perpendicular to the axis of said second shaft to enable said first and second outer races to become aligned with said first and second drive rollers, respectively.

12. The apparatus as claimed in claim 11 in which said second shaft has first and second ends, and in which said idler roller assembly further includes first and second "C" clips for retaining said support member on said first end of second shaft and also includes a spring positioned between said second "C" clip and said document track, said second end of said second shaft having a projection extending therefrom;

said second mounting housing being shaped to receive said second end and also having a locking recess therein whereby said second end of said second shaft may be inserted in said second mounting housing against the bias of said second spring and rotated to enable said projection on said second shaft to engage said locking recess in said second mounting housing to retain said idler roller assembly and said document track on said baseplate.

* * * * *

UNITED STATES PATENT AND TRADEMARK OFFICE

CERTIFICATE OF CORRECTION

PATENT NO. : 4,789,151

DATED : December 6, 1988

INVENTOR(S) : Fredrik L.N. Kallin

It is certified that error appears in the above-identified patent and that said Letters Patent is hereby corrected as shown below:

Column 7, line 6, after the word "member" insert --having spaced upper and--.

Signed and Sealed this

Second Day of May, 1989

*Attest:*

*Attesting Officer*

DONALD J. QUIGG

*Commissioner of Patents and Trademarks*